US007530899B2

(12) United States Patent
Shojiro

(10) Patent No.: US 7,530,899 B2
(45) Date of Patent: May 12, 2009

(54) BALL IMPLEMENT FOR PRACTICING GOLF PUTTING

(76) Inventor: Kato Shojiro, 3-6-5, Higashikoiwa, Edogawa-ku, Tokyo (JP) 133-0052

( * ) Notice: Subject to any disclaimer, the term of this patent is extended or adjusted under 35 U.S.C. 154(b) by 0 days.

(21) Appl. No.: 10/875,655

(22) Filed: Jun. 23, 2004

(65) Prior Publication Data

US 2004/0235579 A1 Nov. 25, 2004

Related U.S. Application Data

(63) Continuation of application No. PCT/JP02/13387, filed on Dec. 20, 2002.

(30) Foreign Application Priority Data

Dec. 26, 2001 (JP) ..... 2001-394055

(51) Int. Cl.
*A63B 69/36* (2006.01)

(52) U.S. Cl. ..... 473/280; 473/588; 473/165; 473/193

(58) Field of Classification Search ..... 473/280, 473/588, 589, 351, 165, 193; 33/508; 273/108.2
See application file for complete search history.

(56) References Cited

U.S. PATENT DOCUMENTS

| | | | | | |
|---|---|---|---|---|---|
| 1,849,414 | A | * | 3/1932 | Turnbull | 473/587 |
| 2,444,810 | A | * | 7/1948 | Creasy | 473/588 |
| 2,454,492 | A | * | 11/1948 | Turnbull | 473/587 |
| 2,812,184 | A | * | 11/1957 | McGee | 473/280 |
| 3,206,210 | A | * | 9/1965 | Bard | 473/588 |
| 4,385,447 | A | * | 5/1983 | Bennett | 33/501 |
| 4,528,759 | A | * | 7/1985 | Joyce et al. | 33/501 |
| 5,486,009 | A | * | 1/1996 | Browne | 473/588 |
| 5,733,213 | A | * | 3/1998 | Colarusso | 473/588 |

FOREIGN PATENT DOCUMENTS

| | | |
|---|---|---|
| JP | 40-740 | 1/1965 |
| JP | 49-138964 | 11/1974 |
| JP | 53-100055 | 8/1978 |
| JP | 57-54468 | 3/1982 |
| JP | 59-196250 | 12/1984 |
| JP | 62-180468 | 11/1987 |
| JP | 62-281977 | 12/1987 |
| JP | 63-56057 | 4/1988 |
| JP | 5-18561 | 3/1993 |
| JP | 3029625 | 7/1996 |

* cited by examiner

*Primary Examiner*—Mark S Graham
(74) *Attorney, Agent, or Firm*—Merchent & Gould P.C.

(57) ABSTRACT

Putting is a very important factor in golf playing. Above all, a putting distance feeling is the hardest to master, and many rounds in golf courses are said to be required for improving putting. Nevertheless, a putter mat is normally only 2- to 3-m long, and a carpet surface or the like that offers the same rolling as by golf greens is hardly available. Many smooth floor surfaces found in homes and firms cannot be used for putting practice due to excessive rolling of golf balls. It is an object of the present invention to eliminate these drawbacks. A ball implement for practicing golf putting is invented which includes a disc provided at the center thereof with a hole, and a main body having a cylindrical portion.

16 Claims, 4 Drawing Sheets

BALL IMPLEMENT FOR PRACTICING GOLF PUTTING

This application is a continuation of international application number PCT/JP02/13387, filed Dec. 20, 2002.

TECHNICAL FIELD

The present invention relates to a ball implement for practicing golf putting and dedicated putt practicing cup, which are utilized on a smooth floor surface.

BACKGROUND ART

As a conventionally used ball for practicing golf putting, those described in Japanese Patent Laid-Open No. 62-281977, Japanese Utility Model Laid-Open Nos. 59-196250, 62-180468, and 63-56057, and Japanese Utility Model Registration No. 3029625 are available. More specifically, the conventional balls for practicing golf putting are formed by covering the surfaces of golf balls with fibrous projections, artificial turf, boa cloth, suction cups, or the like, or by changing the internal materials of golf balls. These golf balls are aimed at enabling putt practice on the floor or tatami-mat floor in the house, or outdoor concrete or asphalt floor easily.

No new matter is introduced by the ammendment and entry thereof is requested.

When rolling, most of the above-mentioned balls provide largely different feeling from that of a ball rolling on the actual green. Also, when the golfer tries to putt such a ball, the putting feeling is very different from ordinary putting feeling. Therefore, the golfer cannot obtain delicate putting feeling which is important to him or her, and cannot be satisfied.

Putting is a very important factor in golf playing. Above all, a putting distance feeling is the hardest to master, and many rounds in golf courses are said to be required for improving putting. Nevertheless, a putting mat is normally only 2- to 3-m long, and a carpet surface or the like that offers the same rolling as by golf greens is hardly available. Many smooth floor surfaces found in homes and firms cannot be used for putt practice due to excessive rolling of golf balls. It is an object of the present invention to eliminate these drawbacks.

DISCLOSURE OF INVENTION

A ball implement for practicing golf putting is invented which includes a disc provided at the center thereof with a hole, and a main body having a cylindrical portion or a semi-spherical portion erected concentrically with the hole, and which accommodates a golf ball or a mimic golf ball for rolling therein. A dedicated practicing cup is also invented which captures a golf ball by using a magnetic force.

BEST MODE FOR CARRYING OUT THE INVENTION

The present invention will be described in detail with reference to the accompanying drawings.

Figure 1:
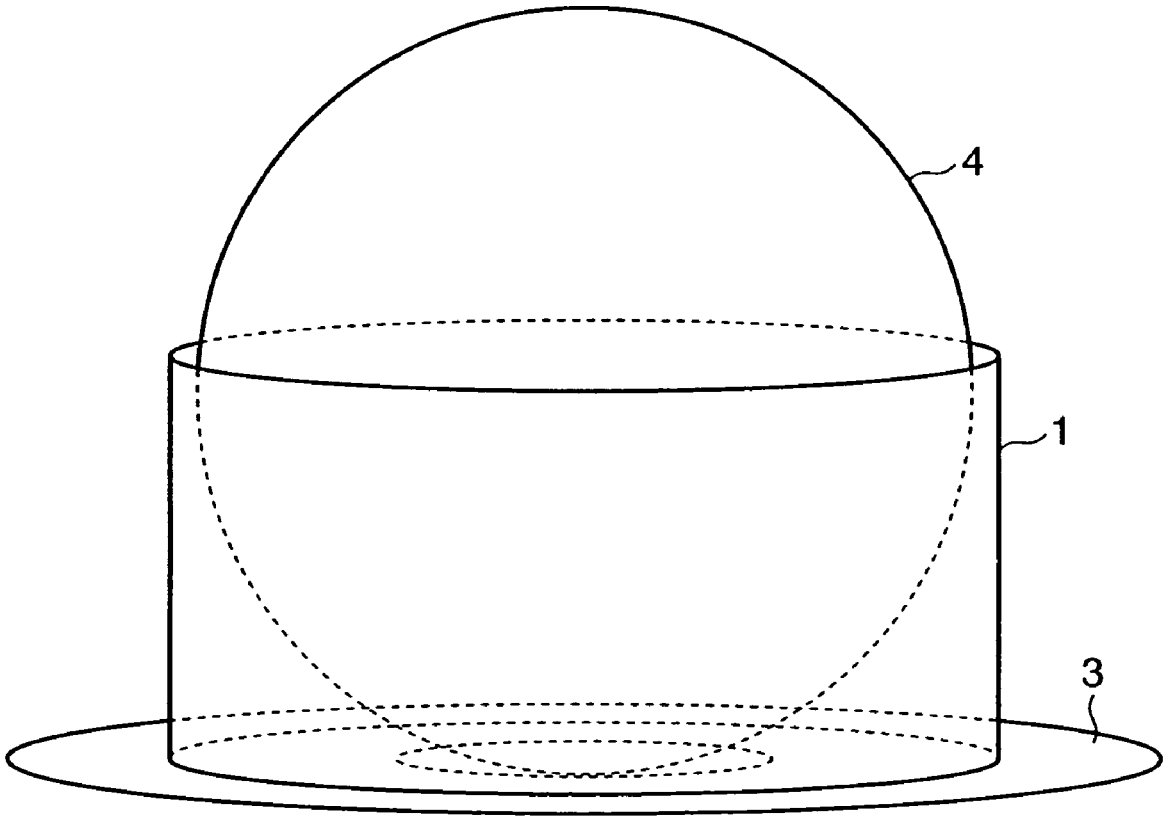
FIGS. 1 and 2 are perspective views showing an embodiment of the present invention.
Figure 2:
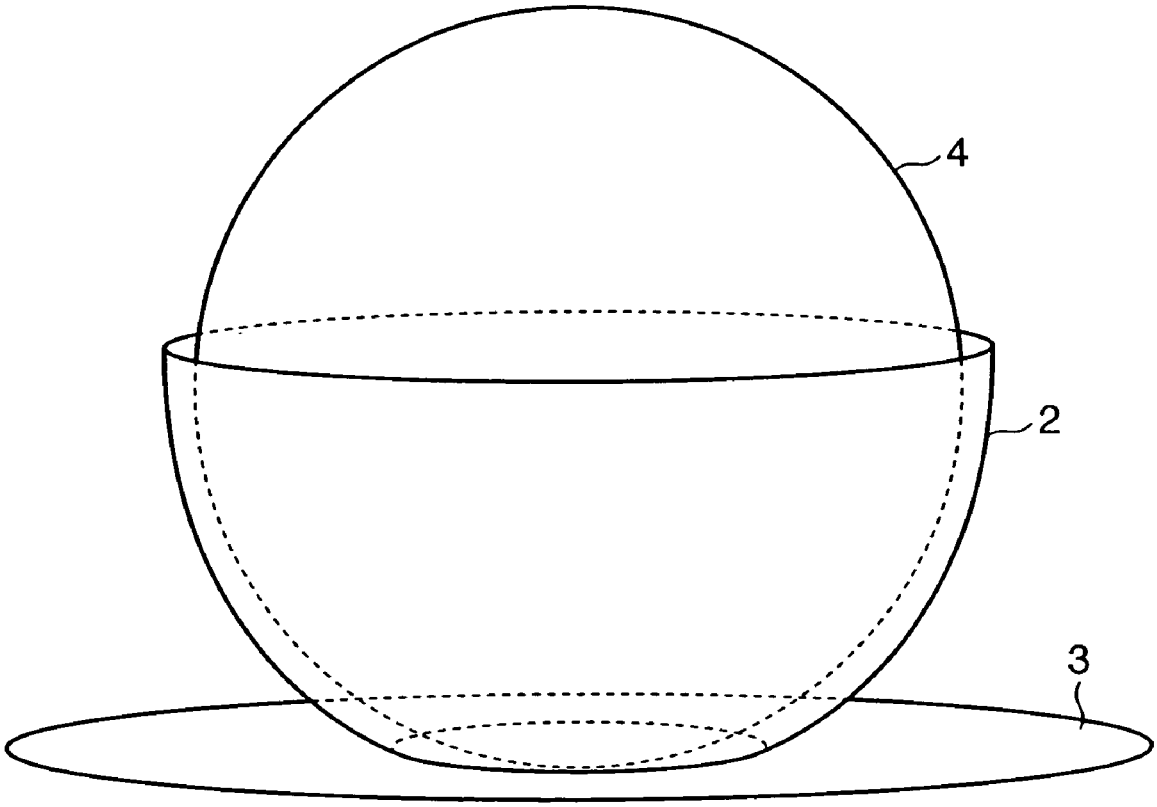

When the present invention is to be employed, a ball implement for practice according to the present invention is placed on a smooth floor surface. A golf ball or mimic golf ball is accommodated as indicated by reference numeral 4 in FIGS. 1 and 2. The ball implement for practice is used by applying an impact to the cylindrical portion (1 in FIG. 1) or semi-spherical portion (2 in FIG. 2) of the main body with a putter head.

Figure 3:
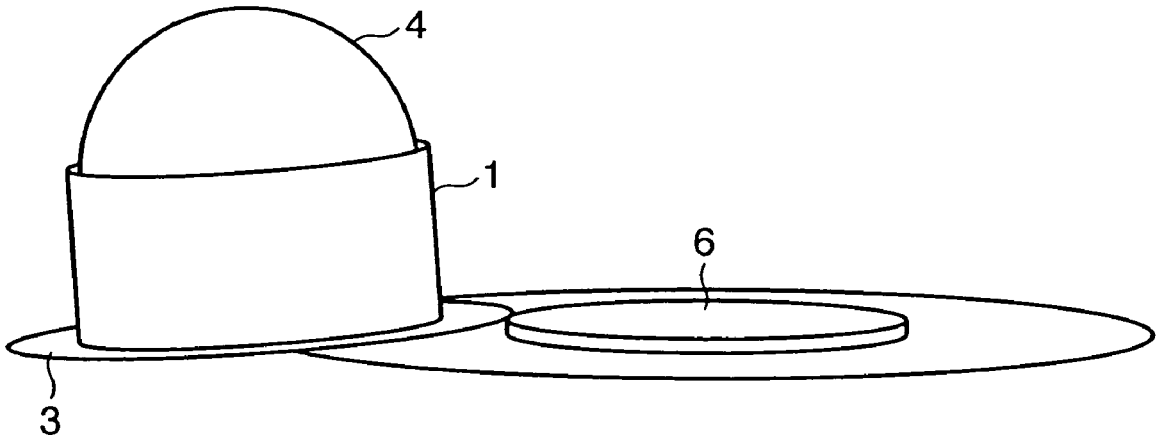
FIG. 3 is a perspective view showing an embodiment according to claim 2 of the present invention.
Figure 4:
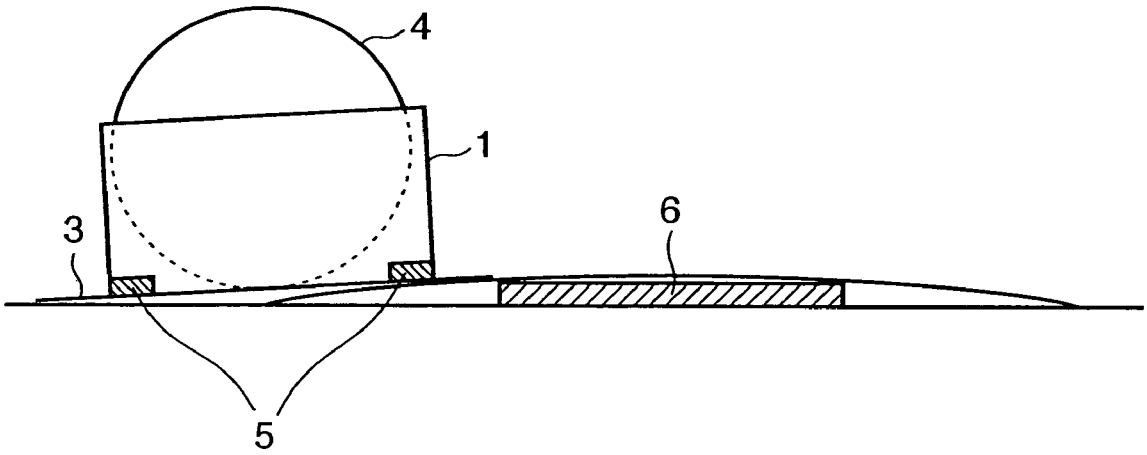
FIG. 4 is a front view showing the embodiment according to claim 2 of the present invention.

FIGS. 3 and 4 show an embodiment according to claim 2 of the present invention.

According to this embodiment, a dedicated putter cup for practice having a thin, strong magnet (6 in FIGS. 3 and 4) at its center and a moderately slanted periphery, and a ball implement for practice disposed with a ring-like magnetic metal plate (5 in FIGS. 3 and 4) are both employed.

The feeling of putting a ball into a cup in actual golf playing is approximated by magnetic forces acting between the dedicated putt practicing cup and ball implement for practice. Then, the delicate putting feeling which is important to the golfer can be further improved.

Usage

The clearance between the golf ball and ball implement for practice according to the present invention is small and constant. The golf ball is stably supported by the ball implement for practice of the present invention, and rolls while receiving a constant resistance. Consequently, the golf ball can roll in a controlled manner and can be stopped stably. When the cylindrical portion or spherical portion of the main body is formed thin, it hardly adversely affects the feeling of impact. Rolling can be accurately adjusted by the total weight and material of the ball implement for practice of the present invention. If an ordinary Stimpmeter is employed together with the ball implement for practice, rolling of the ball implement for practice of the present invention can be set to match the green speed informed by the golf club upon inquiry prior to the round.

The invention claimed is:

1. A ball implement for practicing golf putting, comprising:

a bottom portion comprising a disc having a hole at its center, a trunk portion formed by erecting a cylindrical portion or semi-spherical portion, concentrically with the hole, on said bottom portion to accommodate a golf ball or a mimic golf ball for rolling therein, thus enabling practicing putting on a smooth floor surface; and an annular magnetic body disposed on a bottom surface, wherein said ball implement is employed together with a cup for practicing golf putting in which a thin, strong magnet is buried at a center of a disc having a slanted periphery such that a peripheral portion of said disc comes into tight contract with a floor surface when the cup is placed.

2. A ball implement for practicing golf putting, comprising:

a disc portion in the form of a plate provided at a center thereof with a hole, said disc portion including:

an upper side; and a bottom side forming a bottom surface of said ball implement and defining an outer diameter; and an accommodating portion extending from said upper side of said disc portion and surrounding said hole, said accommodating portion including an open top having an inner diameter larger than a diameter of a golf ball, said accommodating portion adapted to be struck by a putter head and adapted to accommodate the golf ball such that the golf ball can roll therein when said accommodating portion is struck by the putter head, wherein a maximum outer diameter of said accommodating portion is smaller than an outer diameter of said bottom side of said disc portion.

3. The ball implement according to claim 2, wherein said accommodating portion is cylindrical.

4. The ball implement according to claim 2, wherein said accommodating portion forms a cup-shape.

5. The ball implement according to claim 2, wherein said accommodating portion is semi-spherical.

6. The implement according to claim 2, wherein said accommodating portion comprises a wall at least partially surrounding the golf ball accommodated within the accommodating portion, the wall having a height of at least the radius of the golf ball.

7. The implement according to claim 2, wherein said accommodating portion is formed thin.

8. The implement according to claim 3, wherein the accommodating portion is configured to accommodate the golf ball such that the golf ball extends partially through the hole and partially out from the accommodating portion in a direction opposite the hole.

9. The implement according to claim 3, the accommodating portion further comprising an interior surface configured to support an outer surface of the golf ball, and an exterior surface having a cup-shape.

10. The ball implement of claim 2, wherein said accommodating portion includes an outer profile that extends from proximate said disc portion to proximate an opposite top end of said accommodating portion.

11. The ball implement of claim 10, wherein said top end extends to at least a horizontal equator of the golf ball when the golf ball is accommodated by said accommodating portion.

12. The ball implement of claim 2, wherein said accommodating portion is arranged and configured to provide a substantially constant resistance to the golf ball when the golf ball is rolling therein.

13. The ball implement of claim 2, wherein said accommodating portion includes an outer profile that is semi-spherical such that said accommodating portion outer profile follows a shape of the golf ball when the golf ball is accommodated by said accommodating portion.

14. The ball implement of claim 13, wherein said accommodating portion includes an interior surface and an exterior surface, said interior surface arranged to provide a substantially constant resistance to the golf ball when the golf ball is rolling in said accommodating portion, and wherein said exterior surface includes said outer profile.

15. An implement for practicing golf putting, having a ball implement and a cup, wherein said ball implement comprises: a disc portion provided at a center thereof with a hole; an accommodating portion erecting on said disc portion to surround the hole and accommodating a golf ball such that the golf ball can roll therein; and an annular magnetic metal plate arranged on said disc portion to surround the hole, and said cup comprises: a disc slanted downward from a central portion thereof to a peripheral portion thereof; and a magnet buried at the central portion of said disc.

16. An implement for stably supporting a golf ball while practicing putting on a smooth floor surface, the implement comprising:

(A) a bottom portion in the form of a thin annular ring, the bottom portion including:

(i) a circular outer periphery having a first diameter;

(ii) a circular inner periphery, the inner periphery having a second diameter that is less than the first diameter;

(iii) a smooth flat bottom surface configured to slide across a smooth floor surface, the bottom surface extending from the outer periphery to the inner periphery; and (iv) a top surface extending from the outer periphery to the inner periphery; and (B) an accommodating portion in the shape of a partial semi-spherical cup, the accommodating portion including:

(i) a circular top end having a third diameter, the third diameter being less than the first diameter and larger than a diameter of the golf ball;

(ii) a circular bottom end defining an aperture, the aperture sized to allow a bottom portion of the golf ball to extend through the aperture to contact the smooth floor surface, the aperture being smaller than the diameter of the golf ball wherein the golf ball is prevented from passing entirely therethrough; and (iii) a thin body coupled to the bottom portion, the thin body including an interior surface and an exterior surface, the thin body extending between the bottom end and the top end, wherein the interior surface has a partial semi-spherical shape, wherein the exterior surface is shaped to follow a shape of the golf ball and is arranged and configured to be struck by a putter, and wherein the interior surface is arranged and configured to provide frictional resistance when the golf ball is rolling within the accommodating portion to simulate rolling of the golf ball on a putting green.

* * * * *